US007275973B2

(12) United States Patent
Ong

(10) Patent No.: US 7,275,973 B2
(45) Date of Patent: Oct. 2, 2007

(54) TOY AIRCRAFT

(75) Inventor: Kenlip Ong, Midlevels (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/446,001

(22) Filed: Jun. 3, 2006

(65) Prior Publication Data

US 2007/0037468 A1 Feb. 15, 2007

Related U.S. Application Data

(60) Provisional application No. 60/774,504, filed on Feb. 16, 2006, provisional application No. 60/764,661, filed on Feb. 1, 2006, provisional application No. 60/764,109, filed on Jan. 31, 2006, provisional application No. 60/755,725, filed on Dec. 29, 2005, provisional application No. 60/688,314, filed on Jun. 6, 2005, provisional application No. 60/687,369, filed on Jun. 3, 2005.

(51) Int. Cl.
*A63H 27/00* (2006.01)

(52) U.S. Cl. ..... 446/37; 446/454

(58) Field of Classification Search ..... 446/34, 446/37, 61, 454, 456; D21/450
See application file for complete search history.

(56) References Cited

U.S. PATENT DOCUMENTS 2,406,506 A * 8/1946 Northrop ..... 244/13
3,246,861 A 4/1966 Curci
3,748,564 A 7/1973 Ohba
3,796,005 A 3/1974 Chang et al.
3,806,939 A 4/1974 Palmieri
3,898,765 A 8/1975 Lee
3,937,424 A 2/1976 Meier et al.
3,957,230 A 5/1976 Boucher et al.
4,038,590 A 7/1977 Knowlton
4,072,898 A 2/1978 Hellman et al.
4,143,307 A 3/1979 Hansen et al.
4,168,468 A 9/1979 Mabuchi et al.

(Continued)

FOREIGN PATENT DOCUMENTS

EP 0019448 A1 11/1980

(Continued)

OTHER PUBLICATIONS

TYCO, Tyco Catalog, 1993, p. 20, USA.

(Continued)

*Primary Examiner*—Robert E. Pezzuto
*Assistant Examiner*—Alex F. R. P. Rada, II
(74) *Attorney, Agent, or Firm*—Kolisch Hartwell, P.C.

(57) ABSTRACT

A toy aircraft may include an airframe, which may include a fuselage and a wing assembly. The toy aircraft may include at least one propulsion unit mounted to the airframe. The at least one propulsion unit may be operable to propel the toy aircraft. The toy aircraft may include at least one energy source mounted to the airframe. The toy aircraft may include a controller mounted to the airframe. The controller may couple the energy source to one or more of the at least one propulsion unit. The controller may include a gate array, which may be configured to control operation of the propulsion unit to control flight of the toy aircraft.

20 Claims, 12 Drawing Sheets

U.S. PATENT DOCUMENTS

| | | | | |
|---|---|---|---|---|
| 4,194,317 | A | 3/1980 | Kidd | |
| 4,198,779 | A | 4/1980 | Kress | |
| 4,206,411 | A | 6/1980 | Meyer | |
| 4,270,307 | A | 6/1981 | Arigaya | |
| 4,275,394 | A | 6/1981 | Mabuchi et al. | |
| 4,332,103 | A | 6/1982 | Shulman | |
| 4,512,690 | A * | 4/1985 | Johnson | 446/61 |
| 4,760,392 | A | 7/1988 | Yamamoto et al. | |
| 4,765,567 | A | 8/1988 | Gutman et al. | |
| H628 | H | 4/1989 | McIngvale | |
| 4,891,029 | A | 1/1990 | Hutchinson | |
| 4,964,598 | A | 10/1990 | Berejik et al. | |
| 5,087,000 | A * | 2/1992 | Suto | 244/189 |
| 5,100,153 | A | 3/1992 | Welte | |
| 5,330,131 | A | 7/1994 | Burcham et al. | |
| 5,334,076 | A | 8/1994 | Shinozuka | |
| H1469 | H | 8/1995 | Simonoff | |
| 5,507,455 | A | 4/1996 | Yang | |
| 5,602,553 | A | 2/1997 | Polan | |
| 5,629,590 | A | 5/1997 | Yamamoto | |
| 5,634,839 | A | 6/1997 | Dixon | |
| 5,672,086 | A | 9/1997 | Dixon | |
| 5,768,955 | A | 6/1998 | Hauser | |
| 5,769,359 | A | 6/1998 | Rutan et al. | |
| 5,785,281 | A | 7/1998 | Peter et al. | |
| 5,799,045 | A | 8/1998 | Sakuma et al. | |
| 5,810,284 | A | 9/1998 | Hibbs et al. | |
| 5,850,597 | A | 12/1998 | Tanaka et al. | |
| 5,890,441 | A | 4/1999 | Swinson et al. | |
| 5,906,335 | A | 5/1999 | Thompson | |
| 5,925,992 | A | 7/1999 | Orton | |
| 5,995,884 | A | 11/1999 | Allen et al. | |
| 6,102,330 | A | 8/2000 | Burken et al. | |
| 6,130,513 | A | 10/2000 | Orton | |
| 6,257,525 | B1 | 7/2001 | Matlin et al. | |
| 6,445,333 | B1 | 9/2002 | Tanaka | |
| 6,458,262 | B1 | 10/2002 | Reid | |
| 6,520,824 | B1 | 2/2003 | Caroselli | |
| 6,568,980 | B2 * | 5/2003 | Barthold | 446/36 |
| 6,609,945 | B2 | 8/2003 | Jimenez | |
| 6,612,893 | B2 * | 9/2003 | Rehkemper et al. | 446/34 |
| 6,688,936 | B2 | 2/2004 | Davis | |
| 6,843,699 | B2 | 1/2005 | Davis | |
| 6,847,865 | B2 | 1/2005 | Carroll | |
| 6,899,586 | B2 | 5/2005 | Davis | |
| 6,965,816 | B2 | 11/2005 | Walker | |
| 2003/0197092 | A1 | 10/2003 | Tian et al. | |
| 2004/0077284 | A1 | 4/2004 | Bonilla | |
| 2004/0195438 | A1 * | 10/2004 | Chamberlain | 244/65 |
| 2005/0151023 | A1 | 7/2005 | Ribbe | |
| 2005/0173589 | A1 | 8/2005 | Davis | |
| 2005/0191930 | A1 | 9/2005 | Foster et al. | |
| 2006/0144994 | A1 | 7/2006 | Spirov | |
| 2006/0270307 | A1 * | 11/2006 | Montalvo et al. | 446/64 |

FOREIGN PATENT DOCUMENTS

| | | |
|---|---|---|
| FR | 2236237 | 1/1975 |
| FR | 2387066 | 11/1978 |
| GB | 1262647 | 2/1972 |
| GB | 1440338 | 6/1976 |
| GB | 2359286 A | 8/2001 |
| WO | WO 94/08847 | 4/1994 |
| WO | WO 01/91871 | 6/2001 |
| WO | WO 01/58756 A2 | 8/2001 |
| WO | WO 02/04289 A1 | 1/2002 |
| WO | WO 2004-080556 A2 | 9/2004 |
| WO | WO 2004-080556 A3 | 9/2004 |
| WO | WO 2004/101357 A2 | 11/2004 |

OTHER PUBLICATIONS

HLEC Highland (Shenzhen) Electronics Co., LTD., TX2/RX2 Remote Controller with Five Functions, 2002, pp. 1-13, China.

F. F. Mazda (Ed.), Electronics Engineer's Reference Book, 1989, pp. 30/1-31/10, 6th edition, Butterworths, UK.

WIKIPEDIA; *Field-programmable gate array*; http://en.wikipedia.org/wiki/FPGA; printed Nov. 5, 2004.

WIKIPEDIA; *Application-specific integrated circuit*; http://en.wikipedia.org/wiki/Application-specific_integrated_circuit; printed Feb. 16, 2007.

Andraka Consulting Group, Inc.; *FPGA Basics*; http://andraka.com/whatisan.htm; printed Nov. 5, 2004.

Steven Sarns; *Teaching a Computer to Fly*; RC Modeler; Oct. 1999, pp. 14, 16, 18, 20, 22, 24, 26, 28, 30, 32.

Castle Creations; *Pixie-14 User Guide*; Jan. 2000.

Hobbico; *Sky Zap RC Plane instruction manual*; 2001.

Megatech; *X-EC Diversion Flight Manual*; 2003.

Chip Directory; *ABC of electronics terms* (F—FPGA—Field Programmable Gate Array); http://www.xs4all.nl/~ganswijk/chipdir/abc/f.htm; printed Feb. 15, 2007; pp. 6-7.

Chip Directory; *ABC of electronics terms* (M—MCU, MPU); http://www.xs4all.nl/~ganswijk/chipdir/abc/m.htm; printed Jan. 18, 2005; pp. 2, 13-14.

Kid Galaxy; *R/C KG Flyer Instructions*; 2004.

* cited by examiner

TOY AIRCRAFT

This application claims the benefit of U.S. Provisional Patent Application No. 60/687,369, filed Jun. 3, 2005; U.S. Provisional Patent Application No. 60/688,314, filed Jun. 6, 2005; U.S. Provisional Patent Application No. 60/755,725, filed Dec. 29, 2005; U.S. Provisional Patent Application No. 60/764,109, filed Jan. 31, 2006; U.S. Provisional Patent Application No. 60/764,661, filed Feb. 1, 2006; and U.S. Provisional Patent Application No. 60/774,504, filed Feb. 16, 2006. The complete disclosure of the above-identified patent applications are hereby incorporated by reference in their entirety for all purposes.

FIELD OF THE DISCLOSURE

The present disclosure relates generally to toy aircraft and, more particularly, to toy aircraft utilizing differential thrust for flight control and having a control circuit based on a gate array.

BACKGROUND OF THE DISCLOSURE

Examples of remotely controlled aircraft are disclosed in U.S. Pat. Nos. 3,957,230, 4,206,411, 5,087,000, 5,634,839, and 6,612,893. Examples of remotely controlled aircraft utilizing differential thrust for flight control are disclosed in U.S. Pat. Nos. 5,087,000, 5,634,839, and 6,612,893. The disclosures of these and all other publications referenced herein are incorporated by reference in their entirety for all purposes.

SUMMARY OF THE DISCLOSURE

In one example, a toy aircraft may include an airframe, which may include a fuselage and a wing assembly. The toy aircraft may include at least one propulsion unit mounted to the airframe. The at least one propulsion unit may be operable to propel the toy aircraft. The toy aircraft may include at least one energy source mounted to the airframe. The toy aircraft may also include a controller mounted to the airframe. The controller may couple the energy source to one or more of the at least one propulsion unit. The controller may include a gate array, which may be configured to control operation of the propulsion unit to control flight of the toy aircraft.

In one example, a toy aircraft may include a fuselage, a first wing connected to the fuselage, and a second wing connected to the fuselage. The toy aircraft may include at least one first motor disposed on the first wing. At least one first propeller may be driven by one or more of the at least one first motor. The toy aircraft may include at least one second motor disposed on the second wing. At least one second propeller may be driven by one or more of the at least one second motor. The toy aircraft may include a battery. The toy aircraft may include a control circuit, which may include a gate array. The control circuit may be electrically connected to the battery and to at least one of the first and second motors. The gate array may be configured to control flight of the toy aircraft such as by regulating current supplied from the battery to at least one of the first and second motors.

DETAILED DESCRIPTION

Figure 1:
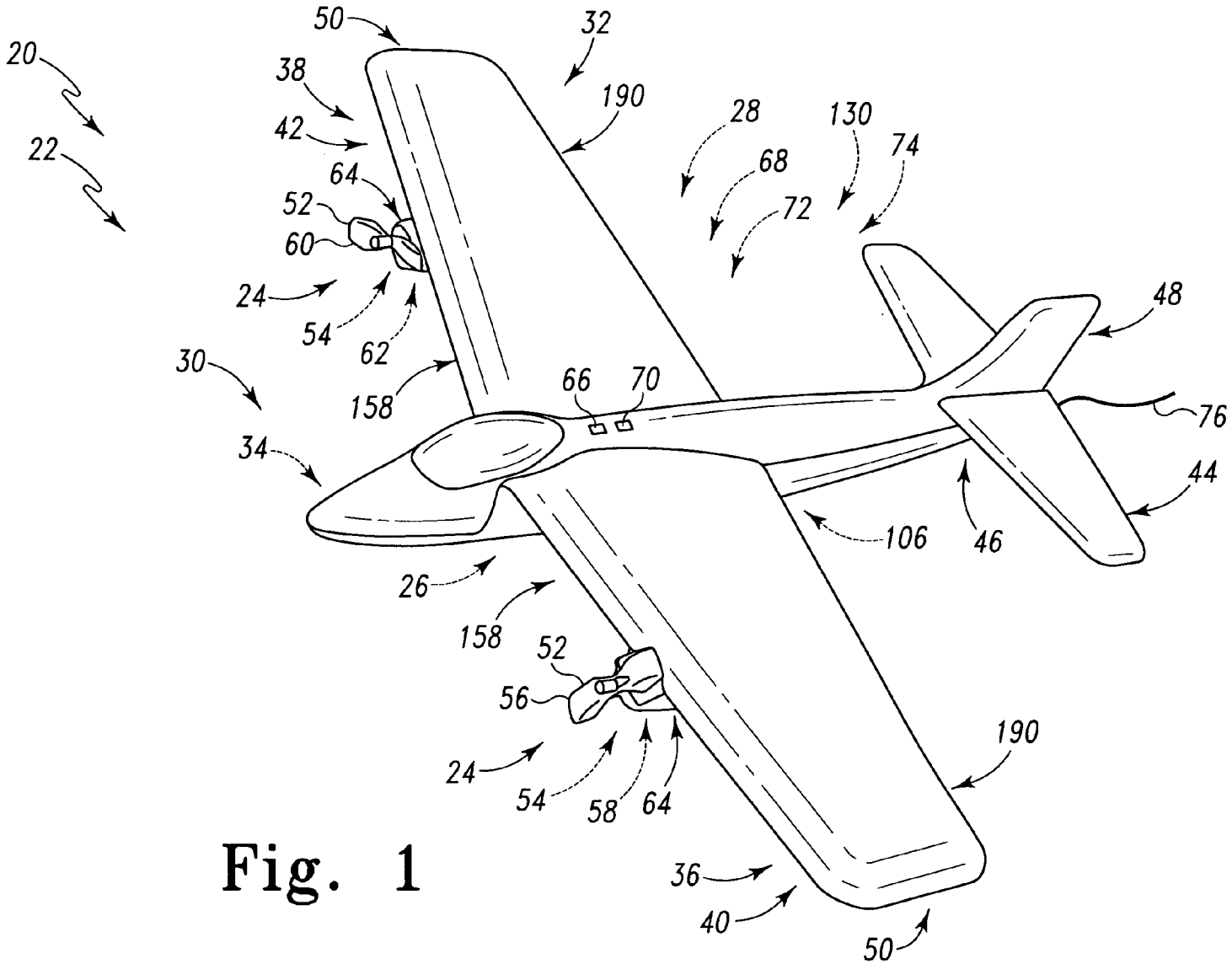
FIG. 1 is a perspective view of an embodiment of a toy aircraft.

An illustrative example of a toy aircraft is shown generally at 20 in FIG. 1. Unless otherwise specified, toy aircraft 20 may, but is not required to, contain at least one of the structure, components, functionality, and/or variations as the other toy aircraft described and/or illustrated herein. Toy aircraft 20 may include an airframe 22, at least one propulsion unit 24, at least one energy source 26, and a controller 28.

Airframe 22 may include a fuselage or body 30 and a wing assembly 32. In some embodiments, at least a portion of body 30 and/or wing assembly 32 may be fabricated from a foamed plastic, such as expanded polystyrene ("EPS") foam and/or expanded polypropylene ("EPP") foam. In some embodiments, at least a portion of body 30, such as a forward region or nose 34, may be fabricated from a resilient material, such as ethylene-vinyl acetate ("EVA") foam, or the like.

Wing assembly 32 may include at least one first wing 36 and at least one second wing 38. As shown in the illustrative embodiment presented in FIG. 1, toy aircraft 20 may be configured as a monoplane such that first wing 36 may be configured as a left wing 40 and second wing 38 may be configured as a right wing 42. In some embodiments (not shown), toy aircraft 20 may include additional wings such that toy aircraft may be configured as a biplane, triplane, or the like. In some embodiments, first wing 36 may be integrally connected to second wing 38 such that wing assembly 32 may comprise an integral unit that may be attached to body 30. In some embodiments, at least one of first wing 36 and second wing 38 may be integrally connected to body 30.

In some embodiments, toy aircraft 20 may include at least one horizontal stabilizer 44. The horizontal stabilizer may be attached to airframe 22 in any suitable location, such as on body 30 or wing assembly 32. As shown in the illustrative embodiment presented in FIG. 1, horizontal stabilizer 44 may be mounted to a rear region 46 of body 30. In some embodiments, horizontal stabilizer 44 may be mounted to body 30 forward of wing assembly 32. In some embodiments, horizontal stabilizer 44 may be separately attached to airframe 22. In some embodiments, horizontal stabilizer 44 may be integrally formed with at least a portion of airframe 22, such as body 30.

In some embodiments, toy aircraft 20 may include at least one vertical stabilizer 48. The vertical stabilizer may be attached to airframe 22 in any suitable location, such as on body 30 or wing assembly 32. As shown in the illustrative embodiment presented in FIG. 1, vertical stabilizer 48 may be mounted to a rear region 46 of body 30. In some embodiments, vertical stabilizer 48 may be separately attached to airframe 22. In some embodiments, vertical stabilizer 48 may be integrally formed with at least a portion of airframe 22, such as body 30 or wing assembly 32. For example, (as shown in the embodiment presented in FIGS. 6-12) at least a portion of wing assembly 32, such as one or more wingtips 50, may be at least partially obliquely oriented relative to the remainder of the wing assembly 32 such as to at least partially provide yaw-stabilization for toy aircraft 20.

Propulsion unit 24 may be operable to propel toy aircraft 20, such as by providing thrust. As shown in the illustrative embodiment presented in FIG. 1, one or more of the at least one propulsion units 24 may include at least one motor 54, which may drive at least one propeller 52. The at least one motor 54 may be any device configured to deliver a mechanical power output or thrust. For example, one or more of the at least one motor 54 may be an electric motor or an internal combustion engine such as a reciprocating engine, a turbine, or the like. In some embodiments, a single motor may drive a plurality of propellers, which may be coaxial, such as through a gearbox or other power transmission mechanism. In some embodiments, a plurality of motors may drive a single propeller. In some embodiments, one or more of the at least one propeller 52 may be connected to one or more of the at least one motor 54 through a set of gears (not shown), such as a set of reduction gears configured such that the propeller rotates at a proportionally lower speed relative to the corresponding motor or motors.

A suitable number of propulsion units 24 may be mounted to airframe 22 in any suitable location or combination of locations. For example, at least one propulsion unit 24 may be mounted on body 30 and/or at least one propulsion unit 24 may be mounted on wing assembly 32. As shown in the illustrative embodiment presented in FIG. 1, toy aircraft 20 may include a first propeller 56 driven by a left or first motor 58, which may be disposed on the first wing 36, and a second propeller 60 driven by a right or second motor 62, which may be disposed on the second wing 38. When a propulsion unit is mounted on the wing, the propulsion unit may be mounted directly to the wing, or the propulsion unit may be mounted in a nacelle 64, which may be at least partially integral to the wing. In some embodiments, nacelle 64 may be at least partially fabricated from a foamed plastic, such as EPS, EPP, or the like.

The at least one energy source 26 may be mounted to airframe 22 in any suitable location, such as within body 30 and/or wing assembly 32, such as to provide toy aircraft 20 with a suitable center of gravity. Energy source 26 may be any suitable source of energy that may be configured to store, produce, and/or supply a form of energy appropriate for the at least one propulsion unit 24. For example, when the at least one propulsion unit 24 includes an electric motor, the at least one energy source 26 may be a source of electric energy, such as an electric storage cell, a battery, a capacitor, and/or a generator or the like, which may be configured to deliver an appropriate level of current, power, and voltage to provide toy aircraft 20 with a desirable level of flight performance. Such cells, batteries or capacitors may be rechargeable, or they may be replaceable. When a replenishable energy source, such as rechargeable cells, batteries or capacitors, are used, toy aircraft 20 may be configured such that energy source 26 may be recharged or replenished without removing energy source 26 from toy aircraft 20. For example, toy aircraft 20 may be provided with a recharging plug or receptacle 66, which may be disposed on airframe 22, as shown in FIG. 1.

The controller 28 may be mounted to airframe 22 in any suitable location, such as within the body 30 and/or wing assembly 32, and may include a control circuit 68. Controller 28 may couple the at least one energy source 26 to one or more of the at least one propulsion unit 24 such that controller 28 may control flight of toy aircraft 20 by controlling the operation of the at least one propulsion unit 24. For example, when the at least one propulsion unit 24 includes at least one electric motor and the at least one energy source 26 includes a battery, control circuit 68 may be electrically connected to the battery and to the at least one electric motor, such as to at least one of first motor 58 and second motor 62. In such an example, control circuit 68 may be configured to control the flight of toy aircraft 20 by regulating current supplied from the battery to the at least one electric motor, such as to at least one of first motor 58 and second motor 62. In some embodiments, control circuit 68 may include a power switch 70, which may be configured to disconnect the at least one energy source 26 from one or more of the at least one propulsion unit 24 and/or from controller 28.

Controller 28 may include a gate array 72, such as within control circuit 68. A gate array is a type of integrated circuit that may also be referred to as an uncommitted logic array (ULA). A gate array is an approach to the design and manufacture of application-specific integrated circuits (ASICS). A gate array may be a prefabricated circuit, which typically lacks a particular function, that may include transistors, standard logic gates, and/or other active devices placed at regular predefined positions, such as on a silicon wafer or die. A desired circuit may be created from a gate array by adding metal interconnects to the chips on the silicon wafer during manufacturing. As such, a gate array may be an integrated circuit comprising a fixed circuit or circuits that may be used to replace a plurality of discrete transistors and/or other logic components. Thus as is known in the art, gate array ASICs are unprogrammable devices. Gate array 72 may be configured to control operation of the at least one propulsion unit 24 to control the flight of toy aircraft 20. For example, when the at least one propulsion unit 24 includes at least one electric motor and the at least one energy source 26 includes a battery, gate array 72 may be electrically connected to the battery and to the at least one electric motor, such as to at least one of first motor 58 and second motor 62. In such an example, gate array 72 may be configured to control the flight of toy aircraft 20 by regulating current supplied from the battery to the at least one electric motor, such as to at least one of first motor 58 and second motor 62.

Controller 28 may control the flight of toy aircraft 20 through differential thrust from the at least one propulsion unit 24. For example, controller 28 may jointly and/or independently vary the thrust output from first motor 58 and second motor 62. The degree of control that may be achieved with differential thrust from the at least one propulsion unit 24 may be sufficient such that traditional movable aerodynamic control surfaces may be partially or entirely omitted from toy aircraft 20 such that the flight of toy aircraft 20 may be controlled solely by controlling the thrust from the at least one propulsion unit 24.

An aircraft that is controllable by differential thrust, such as toy aircraft 20, may be referred to as propulsion controlled aircraft ("PCA"). The pitch (which generally corresponds to up-and-down motion) of a PCA may be controlled such as by equally varying the current supplied to at least some of the motors in unison. For example, increasing the current supplied to both first motor 58 and second motor 62 may cause toy aircraft 20 to enter a climb in addition to increasing the speed of the aircraft. Conversely, decreasing the current to both first motor 58 and second motor 62 may cause toy aircraft 20 to slow and enter a descent. Toy aircraft 20 may be made to turn by increasing the current supplied to some motors relative to the current supplied to other motors, which may result in differential thrust being produced. For example, if the thrust output of first motor 58 is higher than the thrust output of second motor 62, toy aircraft 20 may yaw and roll toward the second motor 62, which may result in a turn toward the second motor 62. Conversely, a higher thrust output from second motor 62, may cause toy aircraft 20 to yaw and roll toward first motor 58, which may result in a turn toward first motor 58.

Some embodiments of toy aircraft 20 may include a radio receiver 74, which may be mounted to airframe 22 in any suitable location, such as within the body 30 and/or wing assembly 32. Radio receiver 74 may include an antenna 76, which may be mounted to airframe 22 in any suitable location. Radio receiver 74 may be connected to controller 28, such that radio receiver 74 may be configured to receive a signal from a transmitter (not shown in FIG. 1) and send the signal to controller 28. Toy aircraft 20 may be configured such that controller 28 may control flight of toy aircraft 20 by controlling the operation of the at least one propulsion unit 24 in response to a signal received by radio receiver 74 and sent to controller 28. For example, when the at least one propulsion unit 24 includes at least one electric motor and the at least one energy source 26 includes a battery, radio receiver 74 may be electrically connected to control circuit 68, which may be electrically connected to the battery and to the at least one electric motor, such as to at least one of first motor 58 and second motor 62. In such an example, control circuit 68 may be configured to control the flight of toy aircraft 20 by regulating current supplied from the battery to the at least one electric motor, such as to at least one of first motor 58 and second motor 62, in response to a signal received by radio receiver 74.

Figure 2:
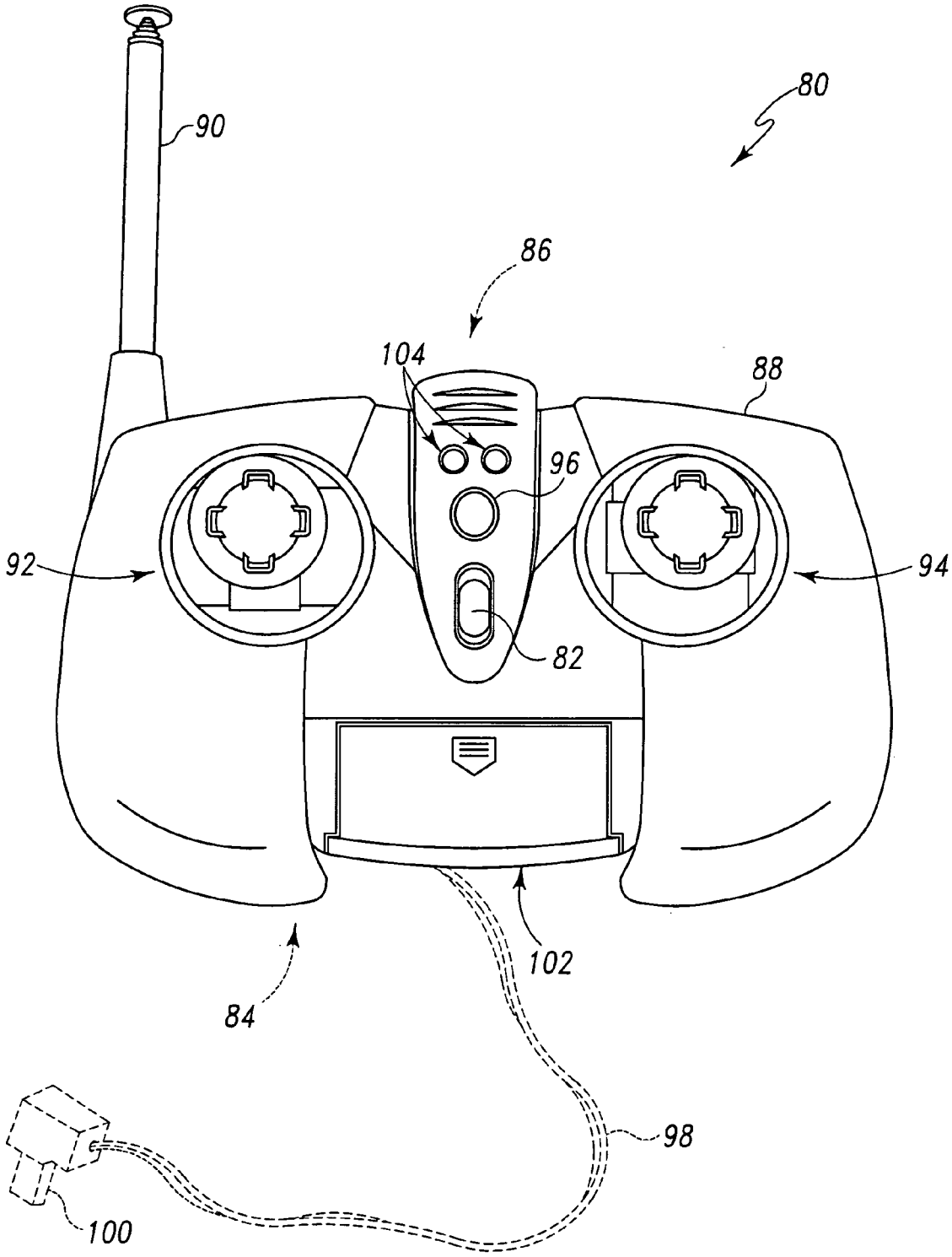
FIG. 2 illustrates a remote control transmitter and charger suitable for use with a toy aircraft.

An illustrative example of a remote control transmitter and charger suitable for use with toy aircraft 20 is shown generally at 80 in FIG. 2. Remote control transmitter and charger 80 may include a power switch 82, a charger circuit 84, a transmitter circuit 86, a housing 88, an antenna 90 mounted to housing 86, a pitch axis controller 92, a yaw axis controller 94, and at least one additional function button 96.

Power switch 82 may include a plurality of positions such as "off," "on," and "charge." When power switch 82 is in the off position, the various functionalities of remote control transmitter and charger 80 may be disabled. When power switch 82 is in the on position, transmitter circuit 86 may be enabled. When the power switch is in the charge position, charger circuit 84 may be enabled such that the at least one energy source 26 of toy aircraft 20, such as rechargeable battery 106, may be recharged.

Charger circuit 84 may include a charger cord 98, a charger plug 100, and a charger cord storage compartment 102. Charger plug 100 may be configured to connect with the recharging plug or receptacle 66 on toy aircraft 20. When not in use, charger cord 98 and charger plug 100 may be stored in the charger cord storage compartment 102. An illustrative example of charger circuit 84 is shown schematically in FIG. 3. Charger circuit 84 may include a charge indicator 104, which may provide an indication of whether the at least one energy source 26 of toy aircraft 20, such as rechargeable battery 106, is charged or whether it is being recharged, and a timer 108 for the charger circuit 84, such as a Texas Instruments CD4060B.

Figure 3:
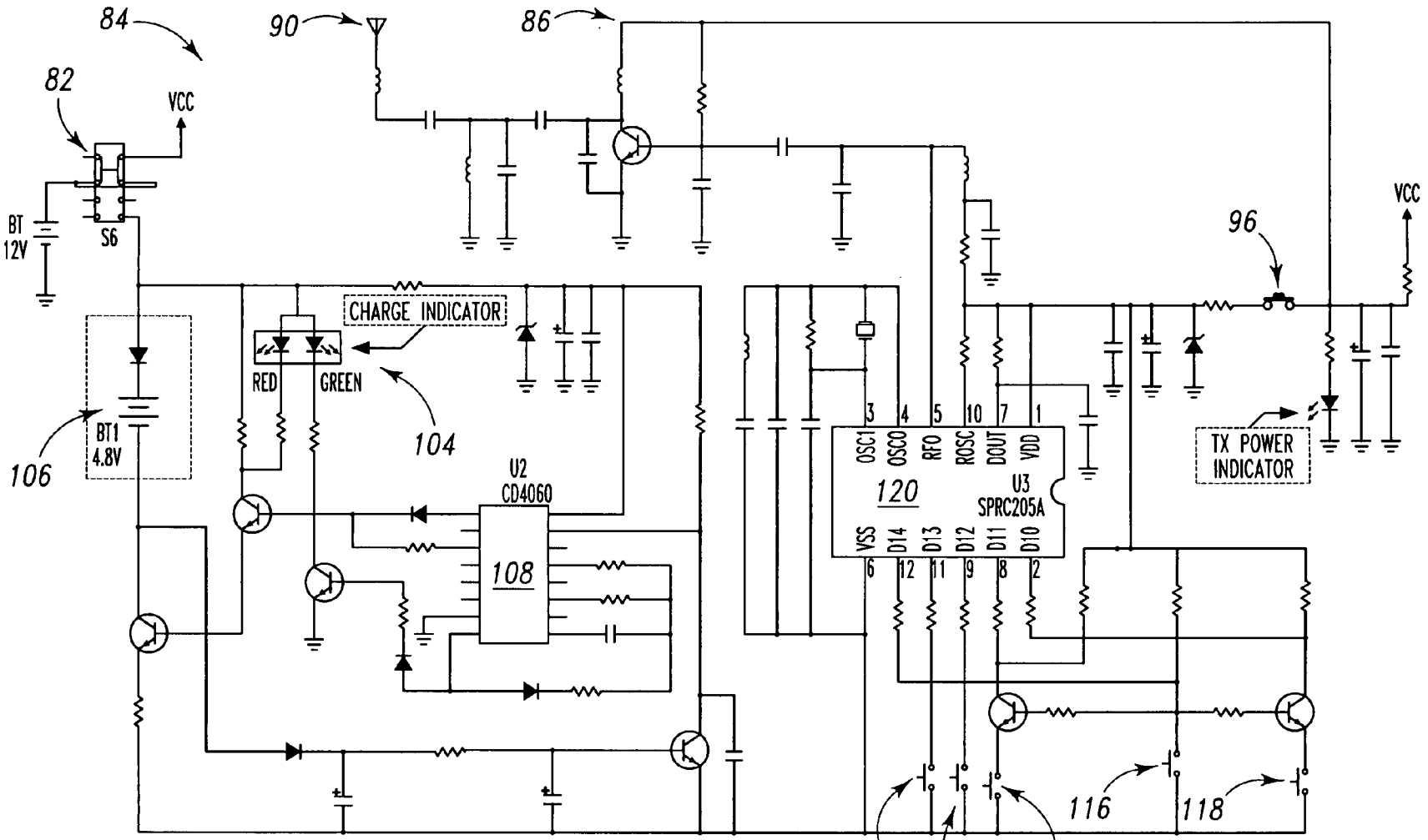
FIG. 3 is a schematic diagram of a transmitter and charger circuit suitable for use with the remote control transmitter and charger of FIG. 2.

An illustrative example of transmitter circuit 86 is shown schematically in FIG. 3. Transmitter circuit 86 may include a plurality of switches 110-118 corresponding to various flight maneuvers to be performed by toy aircraft 20. For example, switch 110 may correspond to left-turning flight, switch 112 may correspond to right-turning flight, switch 114 may correspond to low speed flight, switch 116 may correspond to normal flight, and switch 118 may correspond to high speed flight. Pitch axis controller 92 and yaw axis controller 94 may be configured to close appropriate combinations of switches 110-118 to select a desired flight pattern. For example, pitch axis controller 92 may be configured to selectively close switches 114, 116, and/or 118, and yaw axis controller 94 may be configured to selectively close switches 110 and/or 112. Transmitter circuit 86 may include a five-function remote control encoder 120, such as a Sunplus Technology Co., Ltd. SPRC205A, to encode an appropriate signal based on the desired flight pattern such that transmitter circuit 86 may transmit the signal to radio receiver 74 in toy aircraft 20. In some embodiments, the at least one additional function button 96 may be configured as an "emergency stop" switch, which may be configured to shut down the motors on toy aircraft 20.

Figure 4:
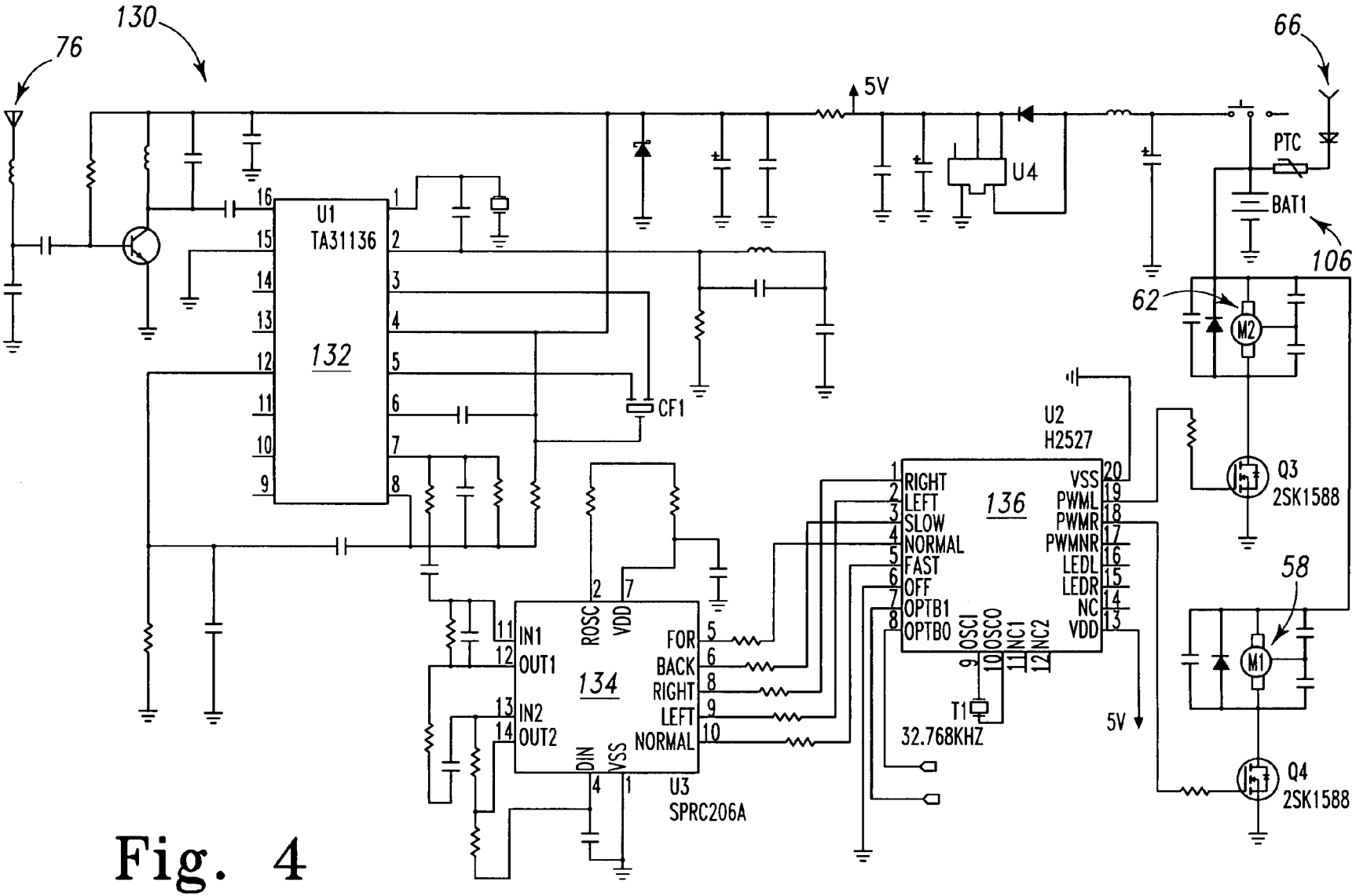
FIG. 4 is a schematic diagram of a reception and control circuit suitable for use with a toy aircraft.

An illustrative example of a reception and control circuit suitable for use with a toy aircraft that includes a radio receiver 74 is shown schematically at 130 in FIG. 4. In some embodiments, reception and control circuit 130 may include radio receiver 74, at least a portion of controller 28 and/or control circuit 68, and a rechargeable battery 106. As shown in the illustrative example presented in FIG. 4, reception and control circuit 130 may include an amplifier/demodulator 132, such as a Toshiba TA31136, a five-function remote control decoder 134, such as a Sunplus Technology Co., Ltd. SPRC206A, which may be configured to decode the signal received from a transmitter, and a motor controller 136, which may include a gate array 72. Motor controller 136 may control the flight of toy aircraft 20 by regulating current supplied from the battery 106 to first motor 58 and second motor 62, in response to a signal received from remote control decoder 134.

Figure 5:
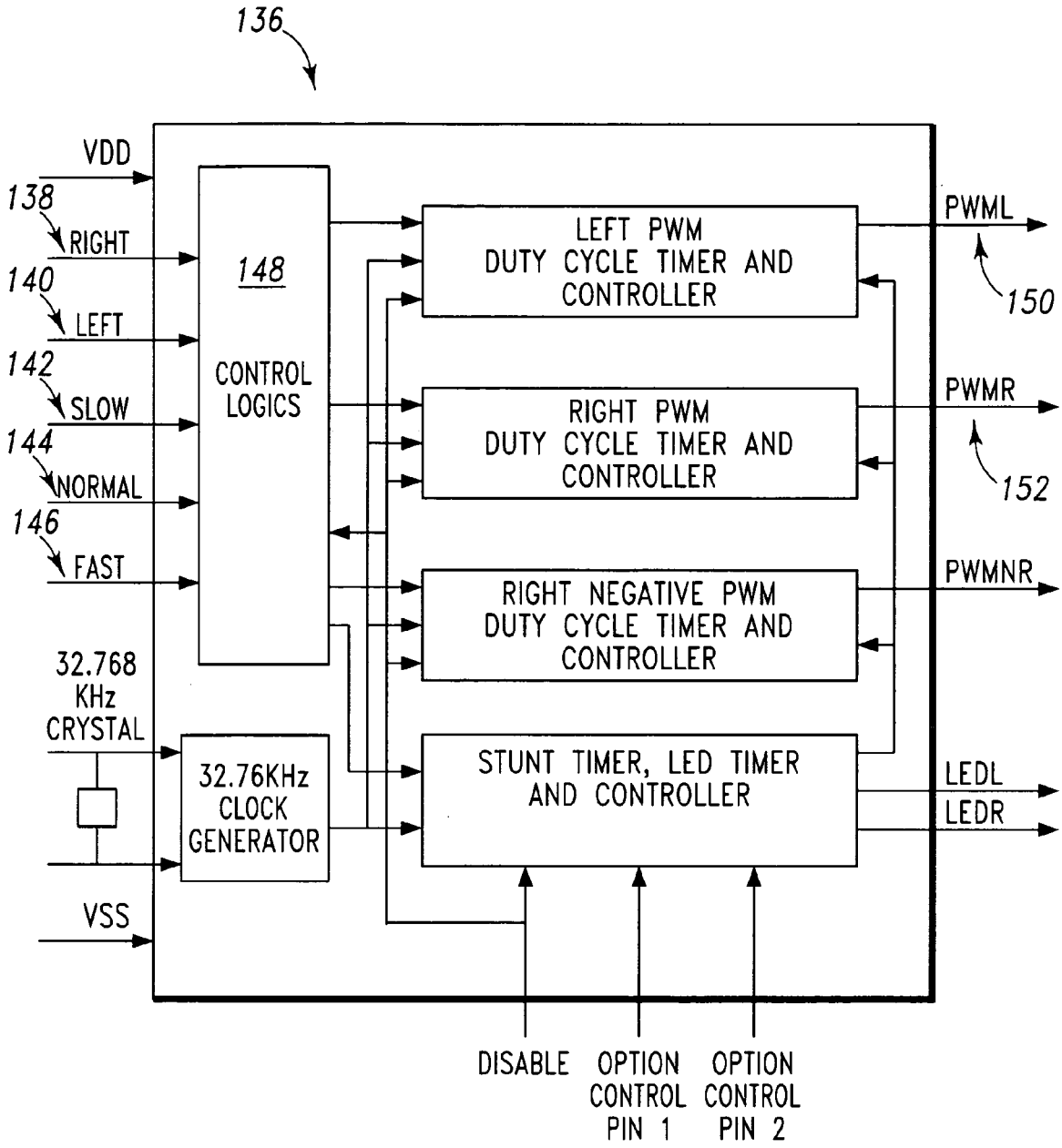
FIG. 5 is a block diagram of a controller chip suitable for use with the reception and control circuit of FIG. 4.

An illustrative example of motor controller 136 is illustrated with the block diagram presented in FIG. 5. Motor controller 136 may receive input signals 138-146, which correspond to right, left, slow, normal, and fast flight modes, respectively. In response to input signals 138-146, the control logics 148 of motor controller 136 may determine an appropriate power level for first motor 58 and second motor 62, which may correspond to left and right motors, respectively. Motor controller 136 may be configured to output pulse width modulation ("PWM") signals 150 and 152 to control the power output of first motor 58 and second motor 62, respectively. The pulse width modulation ("PWM") signals 150 and 152 may range from 0%, which corresponds to the motors being off, to 100%, which corresponds to the motors running at full power. Motor controller 136 may be configured to selectively cause at least one of first motor 58 and second motor 62 to run in reverse, such as to cause toy aircraft 20 to perform a stunt, such as a spin, or the like. Motor controller 136 may be configured to disable at least one of first motor 58 and second motor 62. Motor controller 136 may be configured to control at least one LED that may be disposed on toy aircraft 20.

The following PWM ratios for first motor 58 and second motor 62, as controlled by motor controller 136, are exemplary only. The specific ratios should not be considered limiting. Rather, the given exemplary ratios merely offer guidance as to whether the relative power output of first motor 58 should be greater than, equal to, or less than the relative power output of second motor 62 for a given flight mode. In response to a right input signal 138, motor controller 136 may output a PWM ratio for first motor 58 to be 100% on and second motor 62 to be 70% on. In response to a left input signal 140, motor controller 136 may output a PWM ratio for first motor 58 to be 70% on and second motor 62 to be 100% on. In response to a slow input signal 142, motor controller 136 may output a PWM ratio for both first motor 58 and second motor 62 to be 30% on. In response to a normal input signal 144, motor controller 136 may output a PWM ratio for both first motor 58 and second motor 62 to be 89% on. In response to a fast input signal 146, motor controller 136 may output a PWM ratio for both first motor 58 and second motor 62 to be 100% on.

In some embodiments, motor controller 136 may cause toy aircraft 20 to perform a stunt in response to an appropriate signal, such as from remote control transmitter and charger 80. In response to a stunt signal, motor controller 136 may output a PWM ratio for both first motor 58 and second motor 62 to be 100% on, but with one of the motor 58 and second motor 62 running in reverse, which may cause toy aircraft 20 to spin. Motor controller 136 may output such a PWM ratio for first motor 58 and second motor 62 for a predefined period of time and/or for the duration of the stunt signal. After the predetermined period of time and/or termination of the stunt signal, motor controller 136 may output a PWM ratio for both first motor 58 and second motor right LEDs may alternately flash, such that only one LED is on at any given time, such as at a rate such as 4.5 Hz with a duty cycle such as 50%.

Another illustrative example of a toy aircraft is shown generally at 20 in FIGS. 6-12. Unless otherwise specified, toy aircraft 20 may, but is not required to, contain at least one of the structure, components, functionality, and/or variations as the other toy aircraft described and/or illustrated herein.

Body 30 may be configured into a humanoid shape, as shown in the illustrative embodiment presented in FIGS. 6-12. As used herein, humanoid shape refers to a humanoid body, which should be understood to include any bipedal animal, whether real or fictional, such as, for example, one having arms and hands with opposable thumbs. Body 30 may extend under the wing assembly 32 and may include at least one member 156 that extends forward of a leading edge 158 of wing assembly 32. As shown in the illustrative embodiment presented in FIGS. 6-12, member 156 may be configured to resemble at least one appendage of a humanoid body, such as arms 160. In some embodiments, at least a portion of member 30, such as fists 162, may be fabricated from a resilient material, such as EVA foam, or the like.

In some embodiments, a region of body 30 may be configured to resemble a head 164. As shown in the illustrative embodiment presented in FIGS. 6-12, head 164 may be disposed adjacent leading edge 158 of wing assembly 32. In some embodiments, at least a portion of head 164, such as face 166, may be fabricated from an injection-molded plastic, such as acrylonitrile butadiene styrene ("ABS"), which may be attached to head 164 and/or body 30 via insert molding, co-molding, with an 62 to be 89% on for a predetermined period of time, such as 1.5 seconds, which may stabilize toy aircraft 20 after the stunt. After the stabilizing flight period, motor controller 136 may output a PWM ratio for first motor 58 to be 100% on and second motor 62 to be 70% on for a predetermined period of time, such as 1.0 seconds, which may cause toy aircraft 20 to turn right. After the aforementioned stunt mode, the stabilizing flight period, and/or the right turn period, motor controller 136 may output a PWM ratio for both first motor 58 and second motor 62 to be 100% on, which may cause toy aircraft 20 to climb for a predetermined period of time, such as 3.0 seconds.

In some embodiments, motor controller 136 may be configured to operate one or more LEDs that may be mounted on toy aircraft 20. The one or more LEDs may include a left LED and a right LED. Motor controller 136 may be configured to operate the LEDs in various predefined modes, which may correspond to various flight modes of toy aircraft 20. For example, when toy aircraft 20 is in a fast flight mode, the left and right LEDs may both be on. When toy aircraft 20 is in a normal flight mode, the left and right LEDs may both flash at a rate such as 4.5 Hz with a duty cycle such as 50%. When toy aircraft 20 is in a slow flight mode, the left and right LEDs may both flash at a rate such as 1.5 Hz with a duty cycle such as 50%. When toy aircraft 20 is in a turn, one LED may flash while the other LED may be off. For example, when toy aircraft 20 is in a left turn, the left LED may flash at a rate such as 4.5 Hz with a duty cycle such as 50% while the right LED may be off. When toy aircraft 20 is in a right turn, the right LED may flash at a rate such as 4.5 Hz with a duty cycle such as 50% while the left LED may be off. When toy aircraft 20 is in a stunt flight mode, such as while spinning, the left and adhesive, and/or using any other suitable process.

Figure 6:
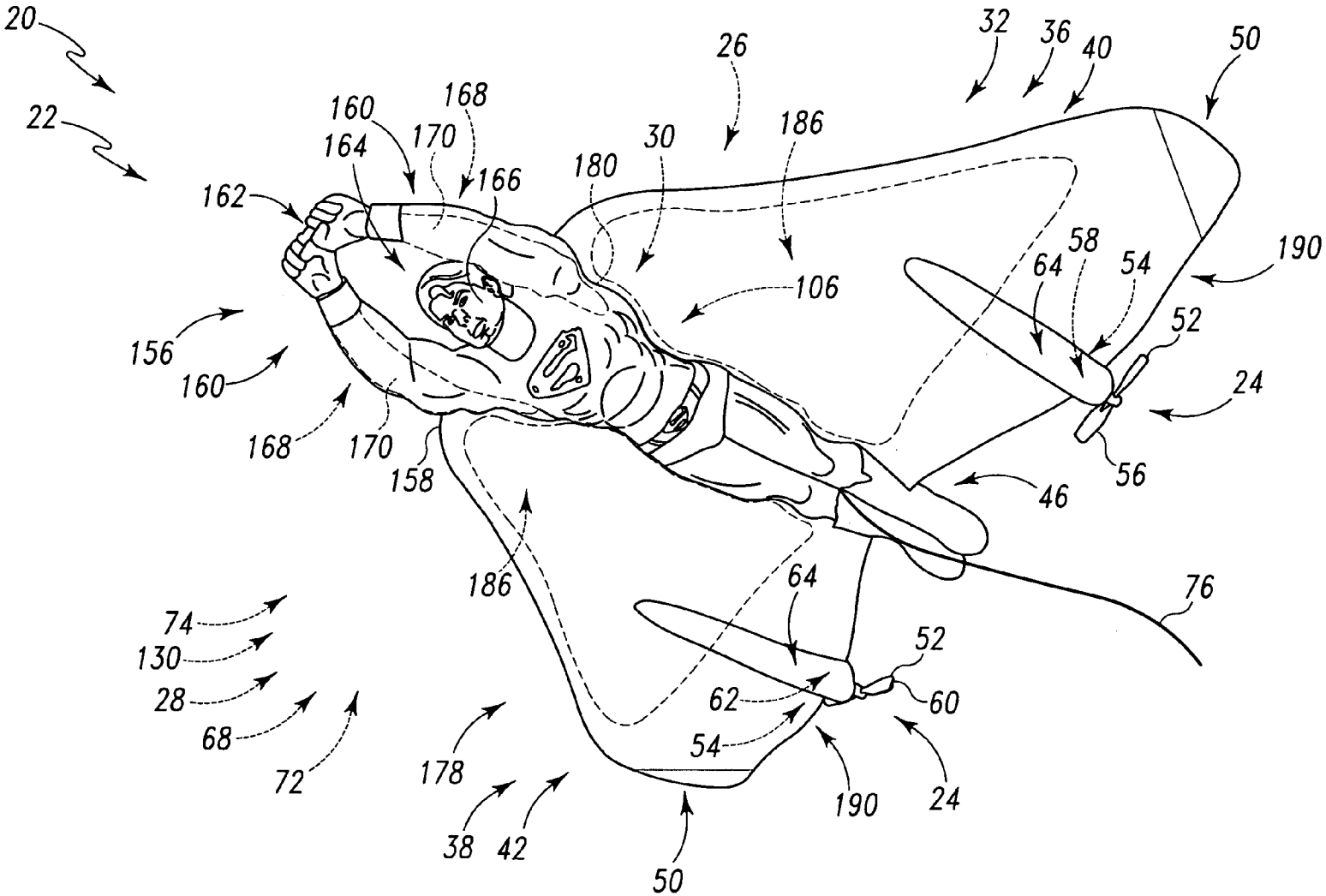
FIG. 6 is a perspective view of another embodiment of a toy aircraft.

At least one reinforcement 168 may be provided on one or more of the at least one member 156 and/or body 30 in some embodiments of toy aircraft 20. Reinforcement 168 may be internal and/or external. For example, as shown in the illustrative embodiment presented in FIGS. 6 and 12, reinforcement 168 may include a reinforced region 170 on at least some exterior surfaces of body 30 and/or member 156. As shown in FIG. 6, reinforced region 170 may extend along at least a portion of the surface region of arms 160 and/or body 30. As an illustrative nonexclusive example, in a body 30 fabricated from EPS or EPP, the reinforced regions 170 on at least some exterior surfaces of body 30 and/or member 156 may be fabricated from a plastic such as polypropylene, polycarbonate, PET plastic, or the like. Reinforced regions 170 may be injection molded and/or formed using any other suitable method such as blow-molding, vacuum-forming, or the like. Body 30 and/or member 156 may be at least partially molded and/or co-molded into reinforced region 170, such as in the manner of bicycle helmets, or reinforced regions 170 may be at least partially attached to body 30 and/or member 156 with an adhesive or other fastener, such as adhesive tape, or the like. The reinforced region may increase the strength of member 156, such as to make member 156 more resistant to breakage, and may provide a degree of abrasion resistance to portions of body 30, such as to minimize abrasion which may occur when toy aircraft 20 lands on a rough surface.

Figure 12:
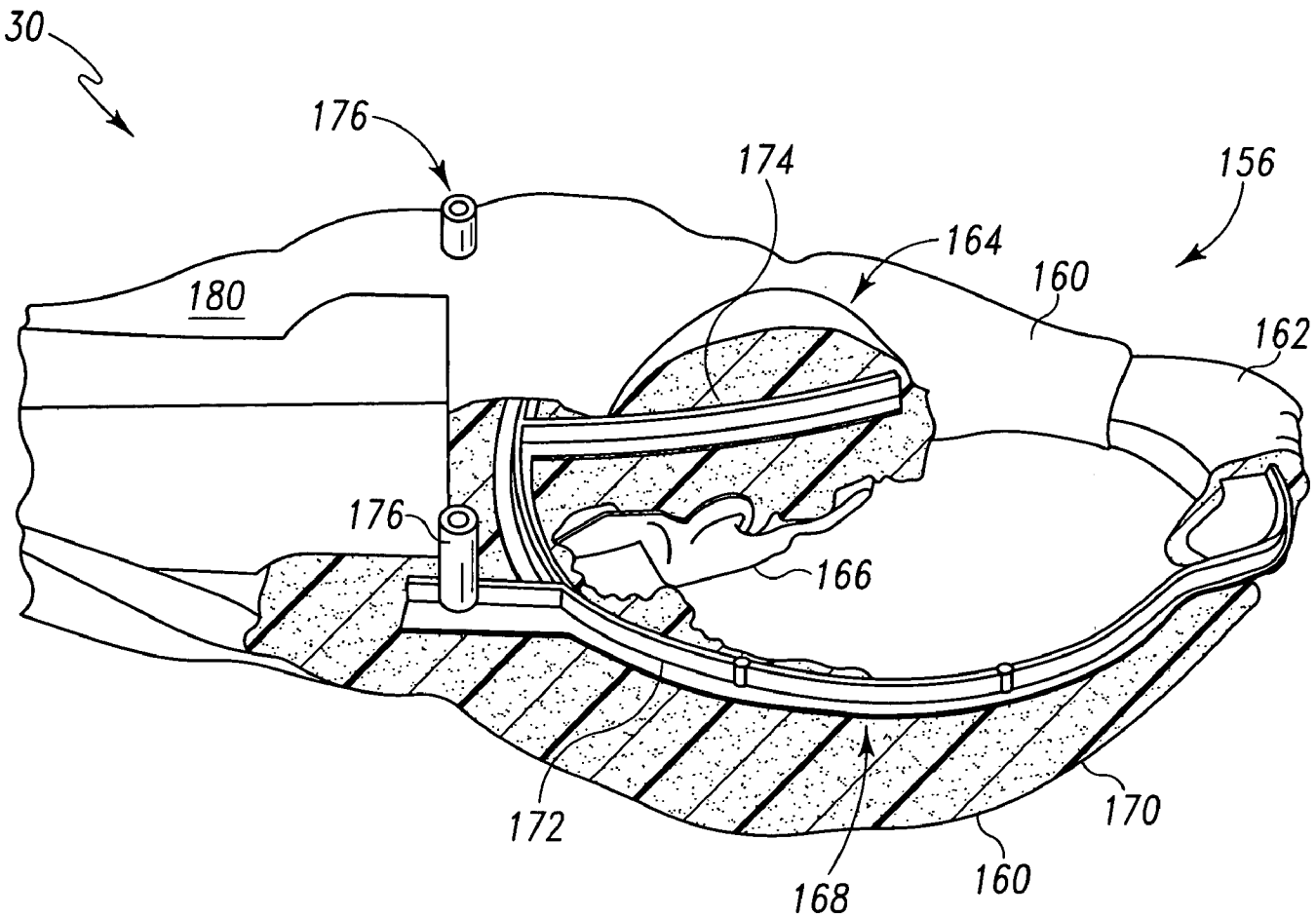
FIG. 12 is a partially cutaway view of a forward portion of the toy aircraft of FIG. 6.

In some embodiments, reinforcement 168 may include a reinforcing insert 172 that may be molded into one or more of the at least one member 156 and/or body 30. As shown in the illustrative embodiment presented in FIG. 12, reinforcing insert 172 may generally extend through at least a portion of member 156 and/or body 30. For example, reinforcing insert 172 may define a loop extending through body 30, arms 160 and fists 162. In some embodiments, reinforcing insert 172 may include at least one extension 174, which may extend into head 168. Reinforcing insert 172 may be fabricated by injection molding from any suitable material, such as polypropylene or the like and may be incorporated into body 30 and/or one or more of the at least one member 156 using any suitable process, such as insert molding. In some embodiments, reinforcing insert 172 may include one or more wing attachment points 176, as shown in FIG. 12.

Figure 7:
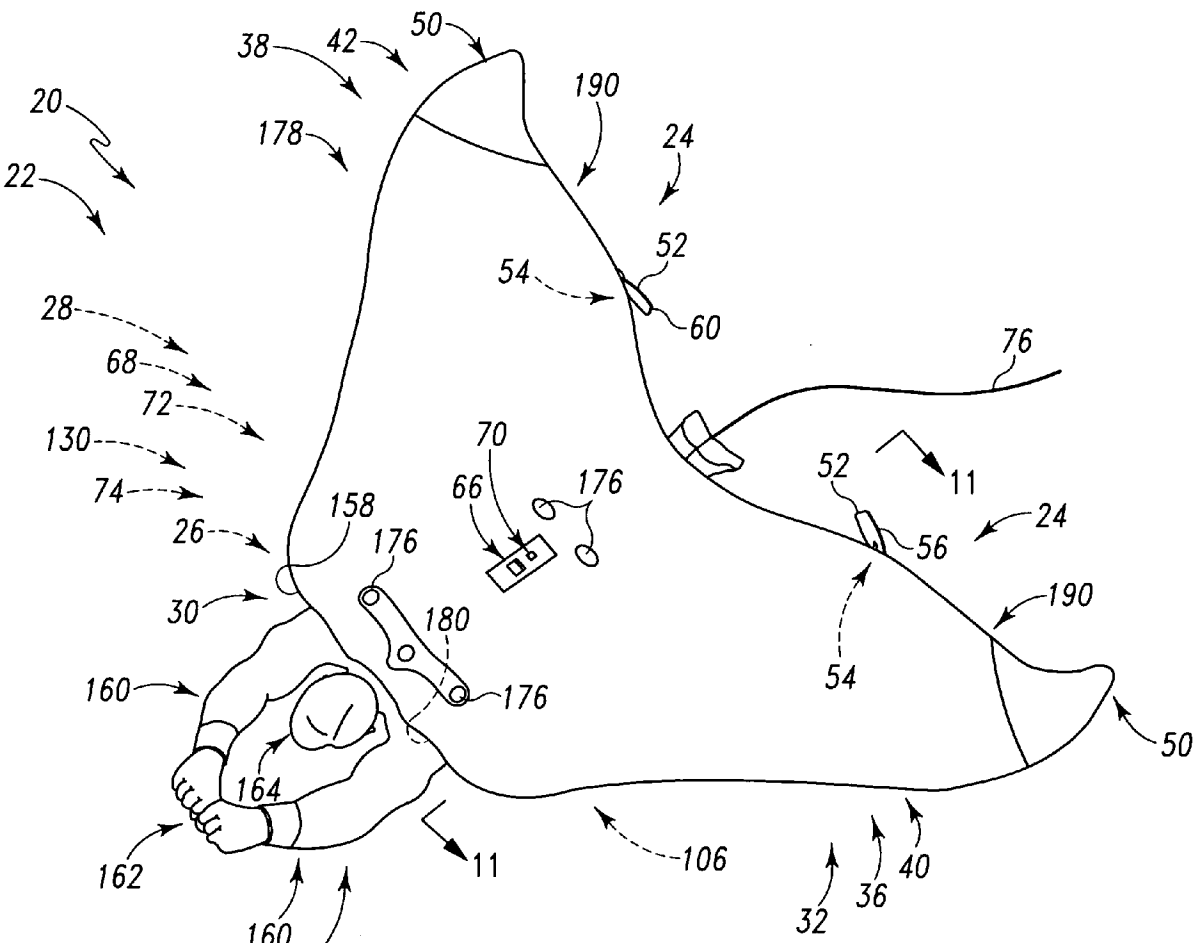
FIG. 7 is a top perspective view of the toy aircraft of FIG. 6.
Figure 8:
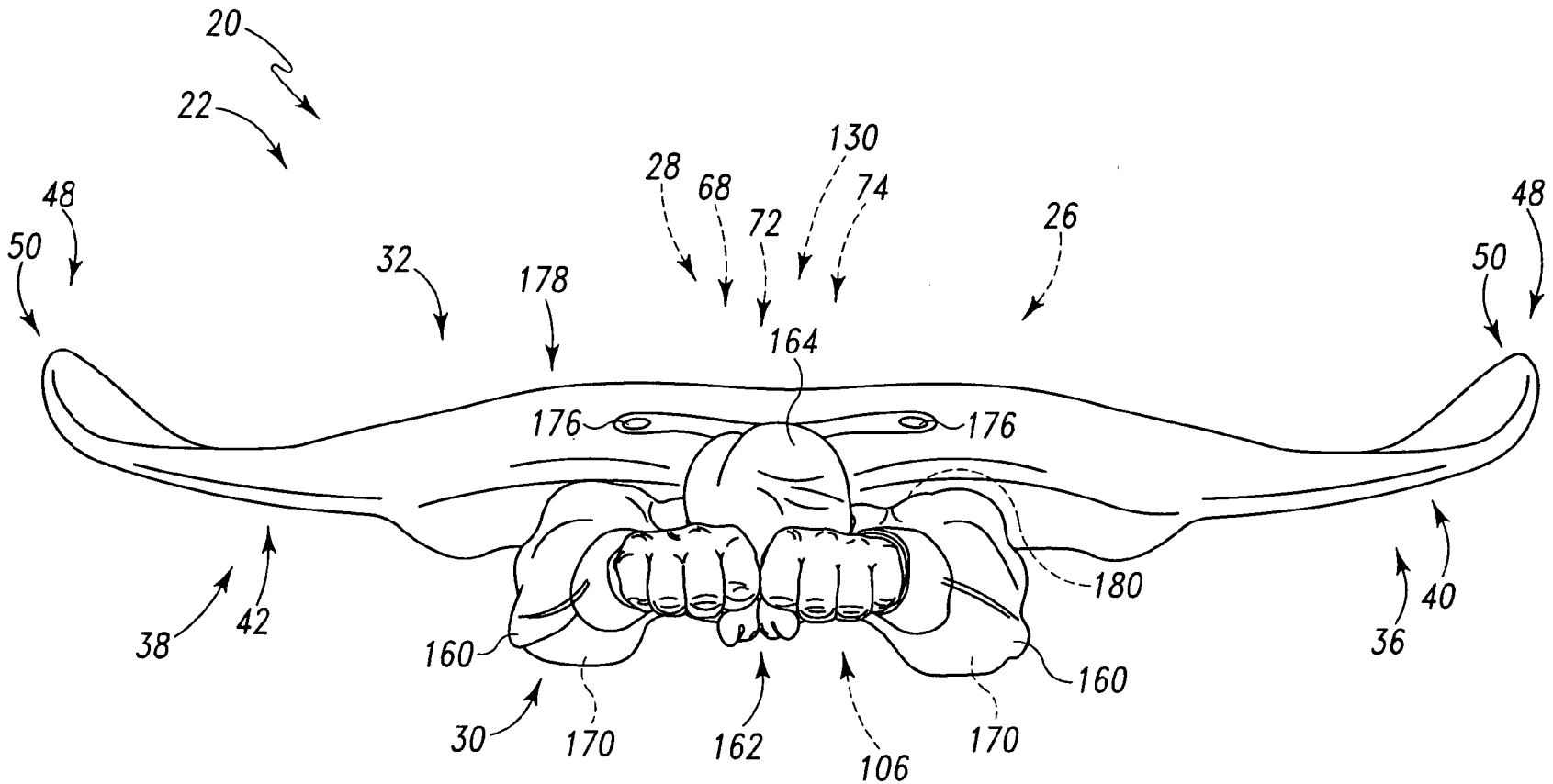
FIG. 8 is a front view of the toy aircraft of FIG. 6.
Figure 9:
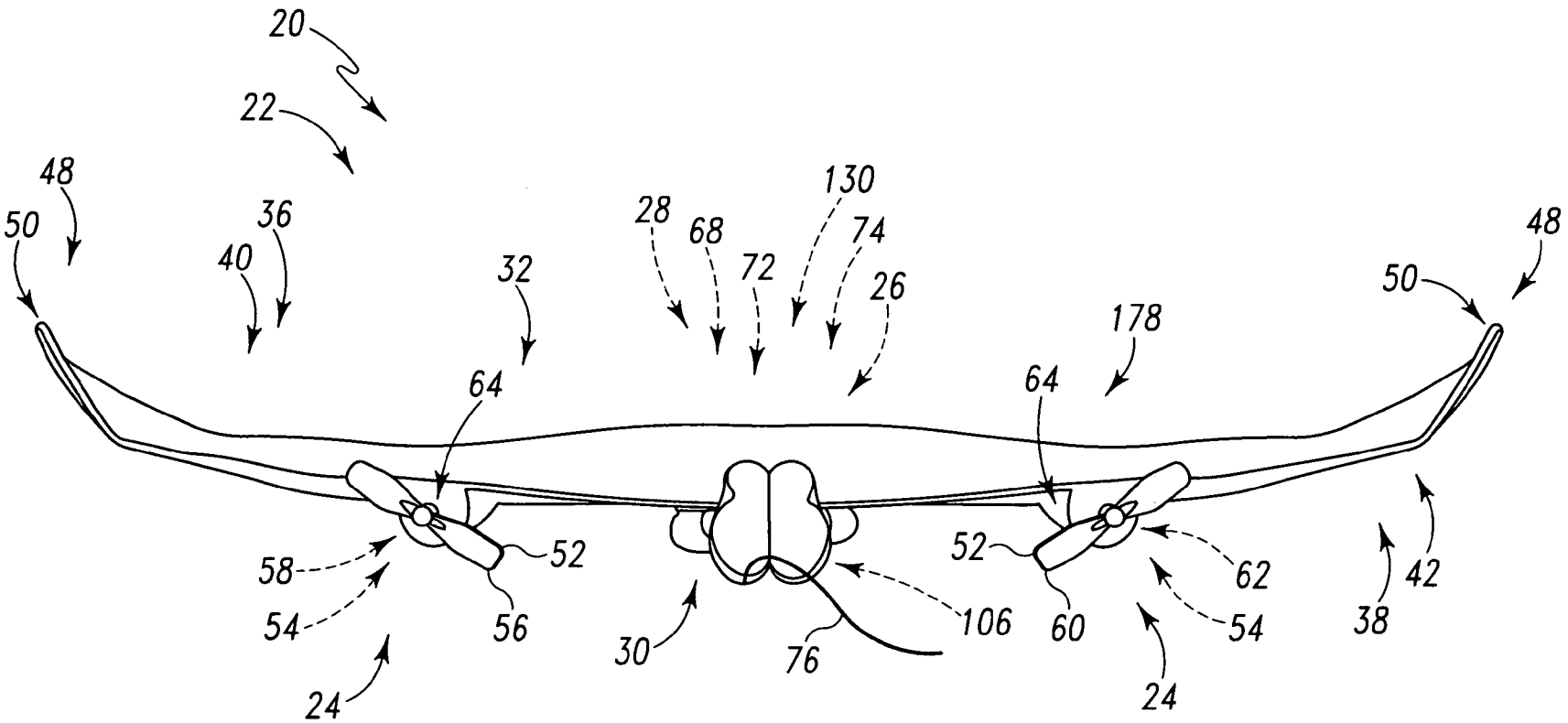
FIG. 9 is a rear view of the toy aircraft of FIG. 6.
Figure 10:
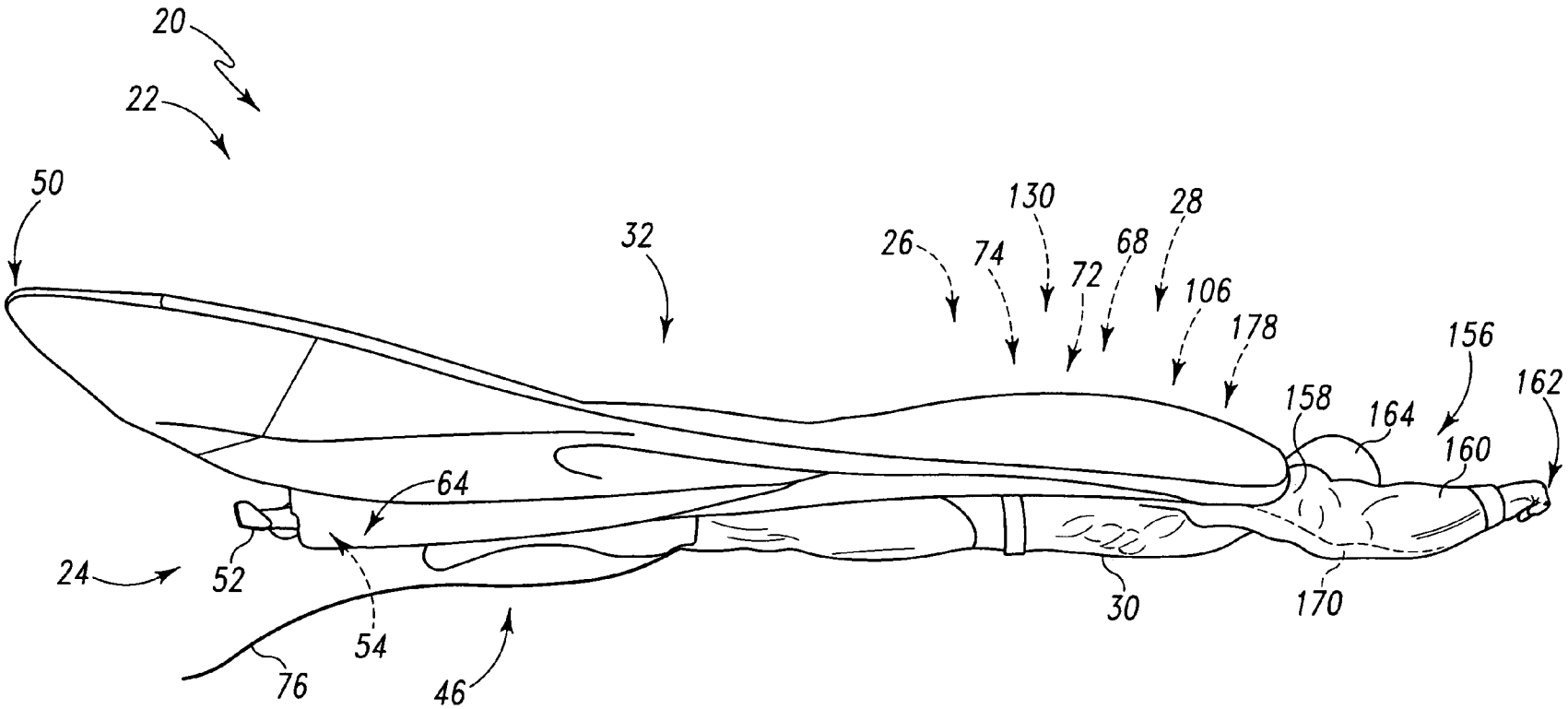
FIG. 10 is a side view of the toy aircraft of FIG. 6.

At least a portion of wing assembly 32 may be configured to resemble at least a portion of a cape 178, as shown in the illustrative embodiment presented in FIGS. 6-12. For example, first wing 36 may be integrally connected to second wing 38 such that wing assembly 32 forms an integral unit that may be attached to the upper surface or back 180 of body 30, and wing assembly 32 may be configured as a compound-delta wing or an ogee delta wing, as shown in FIGS. 6-7, such that wing assembly 32 may resemble a cape 178 attached to the upper surface or back 180 of body 30. As shown in the illustrative embodiment presented in FIGS. 6-7, configuration of toy aircraft 20 as a tailless delta-wing aircraft, such as an ogee tailless-delta aircraft, may simulate a large flowing cape 178 attached to the upper surface or back 180 of body 30. As shown in FIGS. 8-10, the outer portions of cape 178, which correspond to wing tips 50, may provide vertical stabilizers 48 in the form of upturned wing tips 50.

Figure 11:
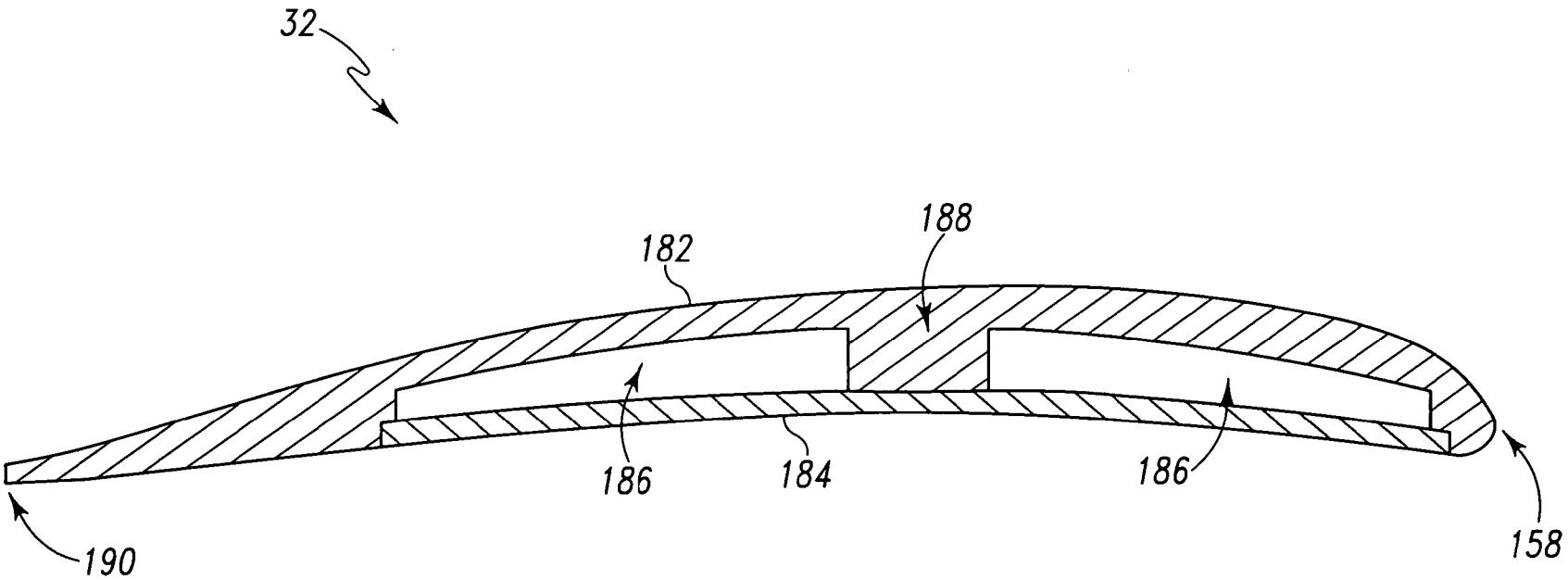
FIG. 11 is a quasi-sectional view of the wing of the toy aircraft of FIG. 6, taken generally along line 11-11 in FIG. 7.

In some embodiments, at least a portion of wing assembly 32, such as at least a portion of at least one of first wing 36 and second wing 38, may be at least partially hollow. As shown in the illustrative embodiment presented in FIGS. 6-12, wing assembly 32 may include an upper wing skin 182 and a lower wing skin 184, each of which may extend over at least a portion of first wing 36 and/or second wing 38. As shown in FIG. 11, upper wing skin 182 and a lower wing skin 184 may enclose at least one cavity 186 therebetween. In some embodiments, first wing 36 and/or second wing 38 may include at least one spar 188. Although the illustrative embodiment presented in FIG. 11 includes one spar 188 and two cavities 186, wing assembly 32 may include any number of cavities and/or spars, which may be arranged in any suitable orientation, both longitudinally and transversely.

In some embodiments, one or more of the at least one propulsion unit 24 may be mounted to airframe 22 proximate a trailing edge 190 of wing assembly 32. As shown in the illustrative embodiment presented in FIGS. 6-12, first motor 58 may be disposed on trailing edge 190 of first wing 36 and second motor 62 may be disposed on trailing edge 190 of second wing 38. In such an embodiment, first propeller 56 and second propeller 60 may be arranged into a pusher configuration.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A toy aircraft, comprising:

an airframe including a fuselage and a wing assembly;

at least one propulsion unit mounted to the airframe and operable to propel the toy aircraft;

at least one energy source mounted to the airframe; and a controller mounted to the airframe and coupling the energy source to one or more of the at least one propulsion unit, the controller including an unprogrammable gate array application-specific integrated circuit configured to control operation of the propulsion unit to control flight of the toy aircraft.

2. The toy aircraft of claim 1, further comprising a horizontal stabilizer mounted to the airframe.

3. The toy aircraft of claim 1, wherein one or more of the at least one energy source is a rechargeable battery and one or more of the at least one propulsion unit is an electric motor.

4. The toy aircraft of claim 1, wherein at least a portion of the airframe is fabricated from a foamed plastic.

5. The toy aircraft of claim 4, wherein the foamed plastic is selected from the group consisting of expanded polypropylene foam and expanded polystyrene foam.

6. The toy aircraft of claim 4, wherein the wing assembly is fabricated from the foamed plastic.

7. The toy aircraft of claim 6, wherein the wing assembly is integrally connected to the fuselage.

8. The toy aircraft of claim 1, comprising a radio receiver mounted to the airframe and connected to the controller, wherein the radio receiver is configured to receive a signal from a transmitter and send the signal to the controller.

9. The toy aircraft of claim 1, wherein the gate array application-specific integrated circuit includes a plurality of devices, at least a first two of the plurality of devices are connected during manufacture of the gate array application-specific integrated circuit to form a first control circuit, and the first control circuit is configured to control operation of the propulsion unit to control flight of the toy aircraft in a first flight mode.

10. The toy aircraft of claim 9, wherein the first flight mode is selected from the group consisting of right-turning flight, left-turning flight, normal flight, and fast flight.

11. The toy aircraft of claim 9, wherein at least a second two of the plurality of devices are connected during manufacture of the gate array application-specific integrated circuit to form a second control circuit, the second control circuit is configured to control operation of the propulsion unit to control flight of the toy aircraft in a second flight mode, and the second flight mode is different than the first flight mode.

12. A toy aircraft, comprising:

a fuselage;

a first wing connected to the fuselage;

a second wing connected to the fuselage;

at least one first motor disposed on the first wing;

at least one first propeller driven by one or more of the at least one first motor;

at least one second motor disposed on the second wing;

at least one second propeller driven by one or more of the at least one second motor;

a battery; and a control circuit including an unprogrammable gate array application-specific integrated circuit, wherein the control circuit is electrically connected to the battery and to at least one of the first and second motors, wherein the gate array application-specific integrated circuit is configured to control flight of the toy aircraft by regulating current supplied from the battery to at least one of the first and second motors.

13. The toy aircraft of claim 12, wherein the battery is rechargeable.

14. The toy aircraft of claim 12, wherein the fuselage comprises a foamed plastic selected from the group consisting of expanded polypropylene foam and expanded polystyrene foam.

15. The toy aircraft of claim 12, comprising a radio receiver electrically connected to the control circuit, wherein the gate array application-specific integrated circuit is configured to regulate the current supplied from the battery to at least one of the first and second motors in response to a signal received by the receiver.

16. The toy aircraft of claim 15, wherein the gate array application-specific integrated circuit includes a plurality of devices, at least a first two of the plurality of devices are connected during manufacture of the gate array application-specific integrated circuit to form a first circuit, and responsive to a first signal received by the receiver the first circuit is configured to control flight of the toy aircraft in a first flight mode by supplying current from the battery to the first motor at a first pulse width modulation ratio and to the second motor at a second pulse width modulation ratio.

17. The toy aircraft of claim 16, wherein the first pulse width modulation ratio is different from the second pulse width modulation ratio.

18. The toy aircraft of claim 16, wherein the first pulse width modulation ratio is the same as the second pulse width modulation ratio.

19. The toy aircraft of claim 16, wherein at least a second two of the plurality of devices are connected during manufacture of the gate array application-specific integrated circuit to form a second circuit, and responsive to a second signal received by the receiver the second circuit is configured to control flight of the toy aircraft in a second flight mode by supplying current from the battery to the first motor at a third pulse width modulation ratio and to the second motor at a fourth pulse width modulation ratio.

20. The toy aircraft of claim 16, wherein at least a second two of the plurality of devices are connected during manufacture of the gate array application-specific integrated circuit to form a second circuit, responsive to a second signal received by the receiver the second circuit is configured to control flight of the toy aircraft in a second flight mode by supplying current from the battery to the first and second motors, the current supplied to the first motor causes the first motor to run in a first direction, the current supplied to the second motor causes the second motor to run in a second direction, and the second direction is opposite to the first direction.

* * * * *